US009486064B2

(12) United States Patent
Zhou

(10) Patent No.: US 9,486,064 B2
(45) Date of Patent: Nov. 8, 2016

(54) BRUSH HEAD COMPONENT CONNECTION SYSTEM

(75) Inventor: Mingdong Zhou, Shanghai (CN)

(73) Assignee: Zensun (Shanghai) Science & Technology Limited, Shanghai (CN)

( * ) Notice: Subject to any disclaimer, the term of this patent is extended or adjusted under 35 U.S.C. 154(b) by 470 days.

(21) Appl. No.: 14/007,489

(22) PCT Filed: Mar. 23, 2012

(86) PCT No.: PCT/CN2012/072909

§ 371 (c)(1),
(2), (4) Date: Sep. 25, 2013

(87) PCT Pub. No.: WO2012/136106

PCT Pub. Date: Oct. 11, 2012

(65) Prior Publication Data

US 2014/0013525 A1 Jan. 16, 2014

(30) Foreign Application Priority Data

Apr. 2, 2011 (CN) ..... 2011 1 0084154

(51) Int. Cl.

| | |
|---|---|
| ***A46B 13/02*** | (2006.01) |
| ***A61H 7/00*** | (2006.01) |
| ***A61H 23/02*** | (2006.01) |

(52) U.S. Cl.

CPC ..... *A46B 13/02* (2013.01); *A61H 7/005* (2013.01); *A61H 23/0254* (2013.01); *A61H 2201/1671* (2013.01); *A61H 2201/1692* (2013.01)

(58) Field of Classification Search

CPC A61C 17/3436; A61C 17/222; A61C 17/26; A46B 2200/1066; A46B 13/02; A61H 7/005
See application file for complete search history.

(56) References Cited

U.S. PATENT DOCUMENTS 4,964,398 A * 10/1990 Jones ..... A61H 7/005 15/22.1
5,471,695 A * 12/1995 Aiyar ..... A46B 13/02 15/22.1

(Continued)

FOREIGN PATENT DOCUMENTS

| | | |
|---|---|---|
| CA | 2102472 A1 | 1/2001 |
| CN | 2083043 | 8/1991 |

(Continued)

OTHER PUBLICATIONS

European Search Report of corresponding European Application 12767969.4, dated Aug. 7, 2014.

(Continued)

*Primary Examiner* — Robert Scruggs
(74) *Attorney, Agent, or Firm* — Thomas J. Engellenner; Reza Mollaaghababa; Pepper Hamilton LLP

(57) ABSTRACT

A brush head component connection system, applied in a personal care utensil, comprises: a brush head component and a motor bracket (11) mounted on a personal care utensil casing (13), a motor (10) disposed in the motor bracket (11), and a seal ring (12) located between the motor bracket (11) and the personal care utensil casing (13). A driving shaft of the motor (10) is disposed in holes at the center of the bottoms of the motor bracket (11), the personal care utensil casing (13) and the seal ring (12), and has an end connected to one end of an eccentric shaft (14). The other end of the eccentric shaft (14) deviates from the central position and is connected to the driving shaft connected onto the brush head component. In the brush head component connection system, the motor (10) is connected to the brush head component only through simple components such as the eccentric shaft (14) and the driving shaft, and the motor (40) drives the eccentric shaft to rotate through rotation of the driving shaft, so as to drive the brush head component to rotate; therefore, the energy consumption is low.

7 Claims, 5 Drawing Sheets

(56) References Cited

U.S. PATENT DOCUMENTS

| | | | | |
|---|---|---|---|---|
| 5,649,334 | A * | 7/1997 | Henriquez | B08B 1/04 15/29 |
| 7,157,816 | B2 | 1/2007 | Pilcher et al. | |
| 7,320,691 | B2 | 1/2008 | Pilcher et al. | |
| 2005/0278876 | A1* | 12/2005 | Roth | A46B 13/06 15/28 |
| 2006/0135319 | A1 | 6/2006 | Berman | |
| 2009/0293212 | A1 | 12/2009 | Junkins | |

FOREIGN PATENT DOCUMENTS

| | | | |
|---|---|---|---|
| CN | 2156841 | A | 2/1994 |
| CN | 2393504 | | 8/2000 |
| CN | 2688250 | A | 3/2005 |
| CN | 101965160 | A | 2/2011 |
| DE | 40 10 481 | A1 | 10/1991 |
| JP | 06201055 | A | 7/1994 |
| JP | 10184684 | A | 7/1998 |
| JP | 2003116888 | A | 4/2003 |
| JP | 2008503325 | A | 2/2008 |
| JP | 2009153532 | A | 7/2009 |
| WO | 2006002183 | A2 | 1/2006 |

OTHER PUBLICATIONS

Office Action issued Dec. 15, 2014 with English Text of Office Action corresponding to Japanese Patent Application No. 2014-501421 (10 sheets).

International Search Report, PCT/CN2012/072909, mailed Jun. 28, 2012 (3 pages).

Chinese first Office Action for corresponding Chinese Application 201110084154.X, issued May 28, 2015.

* cited by examiner

BRUSH HEAD COMPONENT CONNECTION SYSTEM

The present application claims the benefit of priority to Chinese Patent Application No. 201110084154.X, titled "BRUSH HEAD ASSEMBLY CONNECTION SYSTEM FOR PERSONAL CARE PRODUCT", filed with the Chinese State Intellectual Property Office on Apr. 2, 2011, the entire disclosure of which is incorporated herein by reference.

FIELD OF THE INVENTION

The present application relates to personal care products, and particularly to a brush head assembly connection system.

BACKGROUND OF THE INVENTION

At present, the structure of a brush head assembly connection system is very important for a personal care product with a large brush head assembly for skin cleansing, or massage or other uses.

In a conventional brush head assembly connection system, a motor is connected to a brush head assembly via a complex additional connecting component, and drives the brush head assembly to rotate via the additional connecting component, which may causes a high energy consumption.

Furthermore, it is also complicated to mount the brush head assembly, which may cause inconvenience in assembling and disassembling of the brush head assembly since the brush head assembly is required to be replaced frequently.

SUMMARY OF THE INVENTION

In view of this, the present application provides a brush head assembly connection system to solve the problem of a high energy consumption of the conventional brush head assembly connection system.

For solving the above problem, the present application provides the following technical solutions.

A brush head assembly connection system for a personal care product includes:

a brush head assembly and a motor bracket each being mounted on a housing of the personal care product;

a motor arranged in the motor bracket; and a sealing ring located between the motor bracket and the housing of the personal care product, wherein a driving shaft of the motor is arranged in holes at a center of a bottom of each of the motor bracket, the housing of the personal care product and the sealing ring, and has an end connected to one end of an eccentric shaft; and the other end of the eccentric shaft deviates from a central position and is connected to an actuating shaft connected to the brush head assembly.

Preferably, a bolt for fixing the motor bracket is arranged in the housing of the personal care product.

Preferably, the brush head assembly includes a brush head and a brush head mounting platform connected to the brush head, wherein, the brush head includes an outer ring and an inner ring which are connected via an elastic flexible connection member;

the outer ring is fixed on the housing of the personal care product via a bayonet mechanism; and a self-lubricating bearing connected to the actuating shaft is arranged at a bottom of the inner ring.

Preferably, the bayonet mechanism includes:

a clamping slot arranged on the housing of the personal care product and having a downward inclining portion and an upward inclining portion;

a clamping projection arranged on an outer surface of the outer ring of the brush head; and an elastic supporting leg arranged at a bottom of the outer ring of the brush head.

Preferably, the sealing ring has a hollow structure, and has an inner portion filled with lubricant.

Preferably, functional material is fixed on the brush head mounting platform.

Preferably, the functional material includes bristles and a massage latex sheet.

Preferably, an eccentric distance of the other end of the eccentric shaft from the central position is ranged from 0.2 mm to 1 mm.

As illustrated in the above technical solutions, in the brush head assembly connection system according to the present application, the motor is connected to the brush head assembly only through simple components such as the eccentric shaft and the actuating shaft. The driving shaft of the motor drives the brush head assembly to rotate through the eccentric shaft and the actuating shaft, which may cause a low energy consumption, thereby solving the problem of a high energy consumption in the conventional brush head assembly connection system.

BRIEF DESCRIPTION OF THE DRAWINGS

For more clearly illustrating embodiments of the present application or the technical solution in the prior art, drawings referred to describe the embodiments or the prior art will be briefly described hereinafter. Apparently, the drawings in the following description are only several embodiments of the present application, and for the person skilled in the art other drawings may be obtained based on these drawings without any creative efforts.

DETAILED DESCRIPTION OF THE INVENTION

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the protection scope of the present application.

Embodiments of the present application provide a brush head assembly connection system to solve the problem of a high energy consumption of the conventional brush head assembly connection system.

Figure 1:
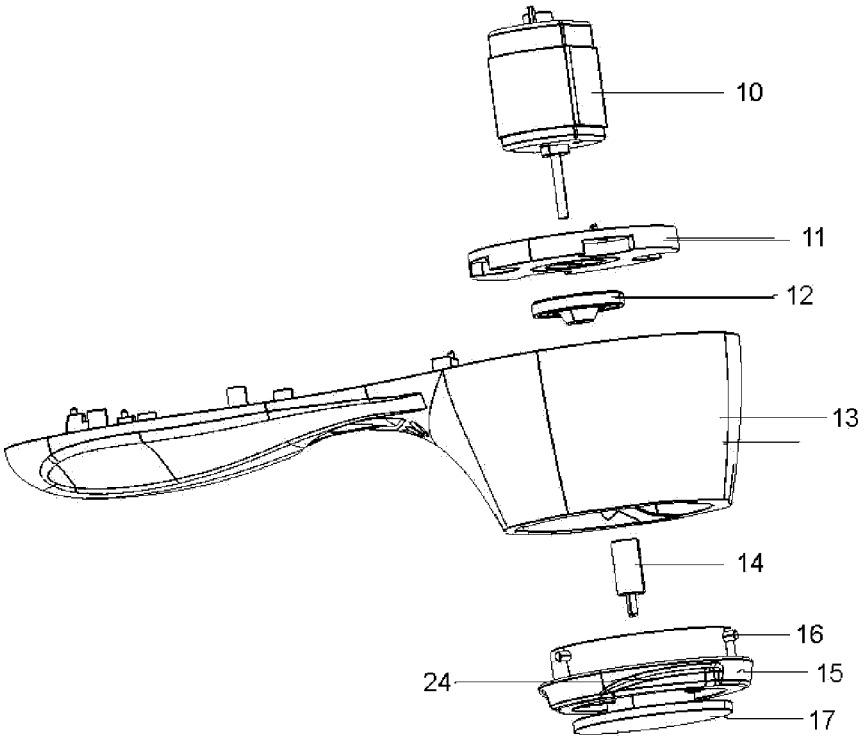
FIG. 1 is an exploded view of a personal care product according to an embodiment of the present application.
Figure 2:
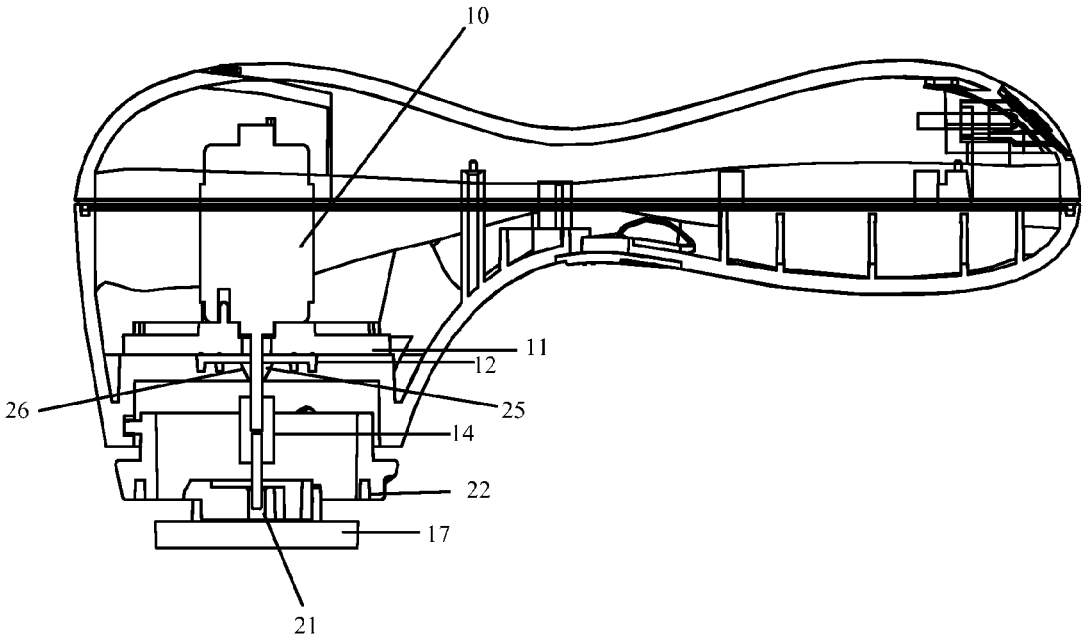
FIG. 2 is a partial sectional view of the personal care product according to the embodiment of the present application.

Referring to FIGS. 1 and 2, a brush head assembly connection system for a personal care product according to an embodiment of the present application includes a motor 10, a motor bracket 11, a sealing ring 12, an eccentric shaft 14 and a brush head assembly; wherein,

- the brush head assembly and the motor bracket 11 are mounted on a housing 13 of the personal care product;
- the motor bracket 11 includes a groove for receiving the motor 10, and the motor 10 is fixed in the groove in the motor bracket 11;
- the sealing ring 12 is located between the motor bracket 11 and the housing 13 of the personal care product, and
- the motor bracket 11, the sealing ring 12, and the housing 13 of the personal care product are each provided with a hole at a center of a bottom portion thereof. In assembling, a driving shaft of the motor 10 passes through the holes in the motor bracket 11, the sealing ring 12 and the housing 13 of the personal care product in sequence, and an end of the driving shaft of the motor 10 protrudes from the housing 13 of the personal care product and is connected to one end of the eccentric shaft 14. The other end of the eccentric shaft 14 deviates from a central position and is connected to one end of an actuating shaft (not shown), and the other end of the actuating shaft is connected to the brush head assembly.

In the brush head assembly connection system according to the embodiment of the application, the motor 10 is connected to the brush head assembly only through simple components such as the eccentric shaft 14 and the actuating shaft. The driving shaft of the motor 10 drives the brush head assembly to rotate through the eccentric shaft 14 and the actuating shaft, which may cause a low energy consumption, thereby solving the problem of a high energy consumption in the conventional brush head assembly connection system.

In the embodiment of the present application, the eccentric shaft 14 has an eccentric distance ranged from 0.2 mm to 1 mm, for example, the eccentric distance may be 0.4 mm or 0.6 mm. Due to the design of the eccentric shaft 14, the actuating shaft may be driven by the driving shaft of the motor to make a circular motion around the driving shaft of the motor and at the same time make a rotation around its own axis relative to other fixing components. The actuating shaft located on the eccentric shaft 14 is fixed in a groove at a center of a bottom portion of the brush head assembly via a self-lubricating bearing 21, such that the actuating shaft may drive the brush head assembly to rotate.

Also as shown in FIG. 2, the sealing ring 12 according to the above embodiments has a hollow structure, an inner side and an outer side of the sealing ring 12 are each of a disc structure 25, and a funnel-shaped cavity 26 filled with lubricant is formed at an inner portion of the sealing ring 12, thus this structure may not only has a lubricating function but also ensure the complete separation between an inner portion and an outer portion of the housing 13 of the personal care product.

Figure 3:
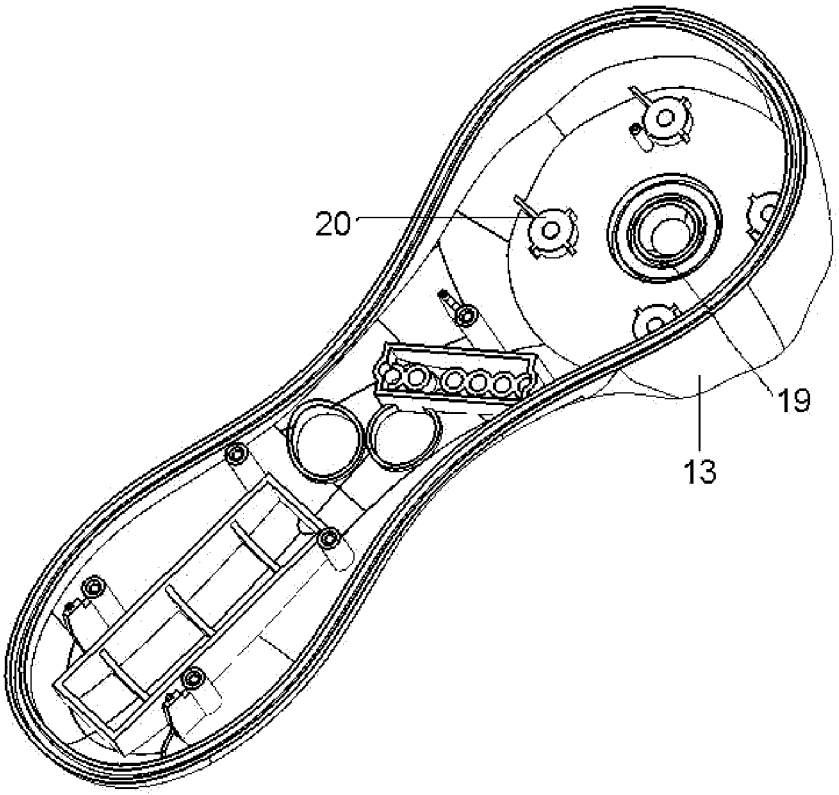
FIG. 3 is a front view of a housing of the personal care product according to the embodiment of the present application.

The structure of the housing 13 of the personal care product according to the embodiments of the present application is shown in FIG. 3. A groove structure 19 matching with the structure of the sealing ring 12 is arranged at a center of the bottom portion of the housing 13 of the personal care product, and a bolt 20 is arranged in the housing 13 of the personal care product, and the motor bracket 11 may be fixed in the housing 13 of the personal care product by the bolt 20, thus the motor can be fixed without a fixing member penetrating the housing of the personal care product. Preferably, four bolts 20 may be arranged.

As shown in FIGS. 1, 2, 5 and 6, the brush head assembly according to the above embodiments includes a brush head 15 and a brush head mounting platform 17 connected to the brush head 15, and

- the brush head 15 includes an outer ring and an inner ring which are connected via an elastic flexible connection member 22;
- the outer ring of the brush head may be fixed on the housing 13 of the personal care product via a bayonet mechanism; and
- the self-lubricating bearing 21 connected to the actuating shaft is arranged at a bottom of the inner ring of the brush head.

Due to the elastic flexible connection member 22, the inner ring of the brush head may only make a circular motion along with the actuating shaft, and make no rotation or only a slight rotation around its own axis. The self-lubricating bearing 21 between the actuating shaft and the groove at the bottom of the inner ring of the brush head may also ensure that the brush head will make no rotation or only a slight rotation around its own axis along with the actuating shaft.

Figure 7:
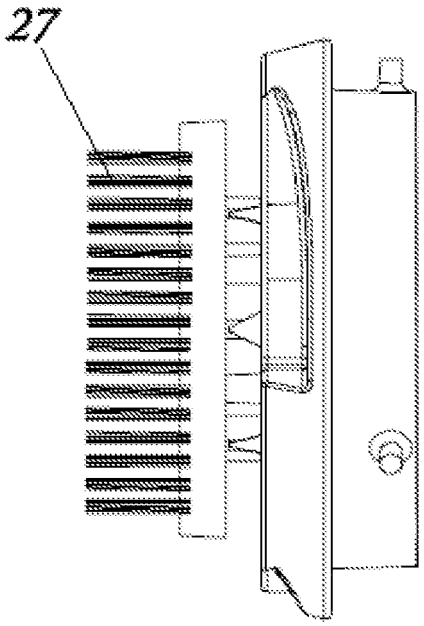
FIG. 7 is a schematic view of a brush head mounting platform having bristles.
Figure 8:
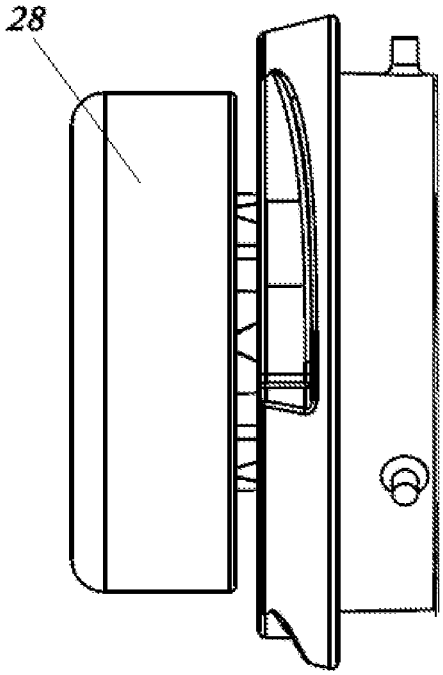
FIG 8 is a schematic view of the brush head mounting platform having a latex sheet.

Also, functional material is fixed on the brush head mounting platform 17 by snap fit, or wrapping, or any other appropriate methods. The fixed material can be selected as required, for example, the fixed material may be bristles 27 for cleansing (FIG. 7), a latex sheet for 28 for massage (FIG. 8), or the like.

Figure 4:
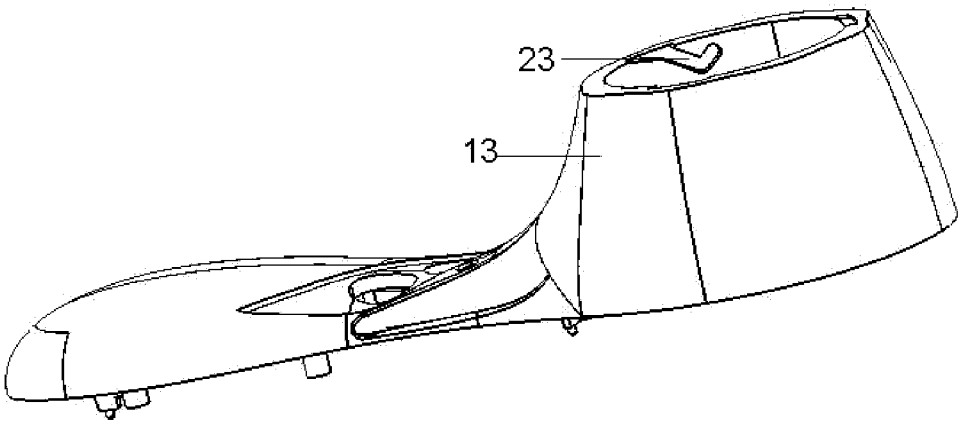
FIG. 4 is a top view of the housing of the personal care product according to the embodiment of the present application.
Figure 5:
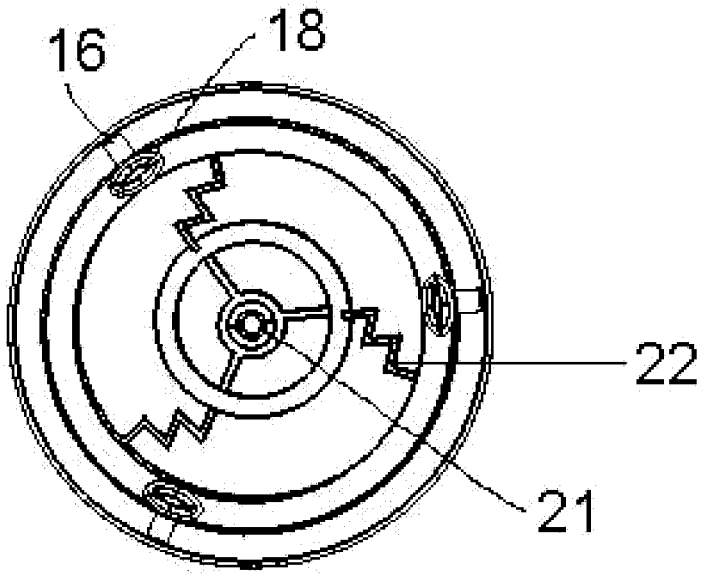
FIG. 5 is a front view of a brush head assembly according to the embodiment of the present application.
Figure 6:
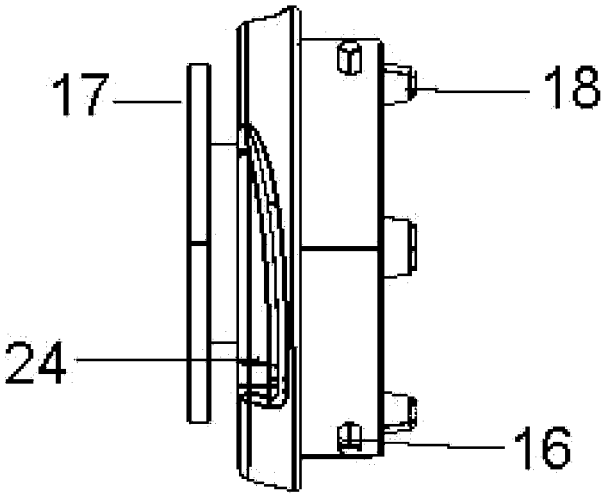
FIG. 6 is a left view of the brush head assembly according to the embodiment of the present application.

As shown in FIGS. 4 and 6, the bayonet mechanism includes a clamping slot 23 arranged on the housing of the personal care product, a clamping projection 16 arranged on an outer surface of the outer ring of the brush head, and an elastic supporting leg 18 arranged at the bottom of the outer ring of the brush head, and,

- the clamping slot 23 arranged on the housing of the personal care product is of a structure having a downward inclining portion and an upward inclining portion.

When mounting the brush head assembly on the housing of the personal care product, the brush head assembly is forcibly pressed and rotated, the outer ring of the brush head assembly presses the clamping slot 23 and then enter into the bottom portion of the housing of the personal care product, and the clamping projection 16 is locked at a top end of the clamping slot 23 via the elastic supporting leg 18, therefore the brush head assembly is fixed on the housing of the personal care product. When disassembling the brush head assembly, the brush head assembly can be pressed and rotated continuously due to the elasticity of the elastic supporting leg 18, and the brush head assembly is rotated in a direction opposite to a rotational direction of the mounting process until the clamping projection 16 is disengaged from the clamping slot 23, therefore the brush head assembly can be removed from the housing of the personal care product.

A number of the clamping slot 23 is same as that of the clamping projection 16, and the location of the clamping slot 23 corresponds to that of the clamping projection 16. Preferably, three clamping slots 23 and three clamping projections 16 may be arranged as shown in the Figure.

The bayonet mechanism according to this embodiment is simple and convenient, and may realize an object of assembling and disassembling the brush head assembly conveniently.

The above embodiments are described in a progressive manner. Each of the embodiments is mainly focused on describing its differences from other embodiments, and references may be made among these embodiments with respect to the same or similar portions among these embodiments.

Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. A brush head assembly connection system for a personal care product, comprising:

a brush head assembly and a motor bracket each being mounted on a housing of the personal care product;

a motor arranged in the motor bracket; and a sealing ring located between the motor bracket and the housing of the personal care product, wherein a driving shaft of the motor is arranged in holes at a center of a bottom of each of the motor bracket, the housing of the personal care product and the sealing ring, and has an end connected to one end of an eccentric shaft; and the other end of the eccentric shaft deviates from a central position and is connected to an actuating shaft connected to the brush head assembly, wherein the brush head assembly comprises a brush head and a brush head mounting platform connected to the brush head, wherein, the brush head comprises an outer ring and an inner ring which are connected via an elastic flexible connection member;

the outer ring is fixed on the housing of the personal care product via a bayonet mechanism; and a self-lubricating bearing connected to the actuating shaft is arranged at a bottom of the inner ring.

2. The system according to claim 1, wherein a bolt for fixing the motor bracket is arranged in the housing of the personal care product.

3. The system according to claim 1, wherein the bayonet mechanism comprises a clamping slot arranged on the housing of the personal care product and having a downward inclining portion and an upward inclining portion;

a clamping projection arranged on an outer surface of the outer ring of the brush head; and an elastic supporting leg arranged at a bottom of the outer ring of the brush head.

4. The system according to claim 1, wherein the sealing ring has an inner portion adapted to be filled with lubricant.

5. The system according to claim 1, wherein functional material is fixed on the brush head mounting platform.

6. The system according to claim 5, wherein the functional material comprises bristles or a massage latex sheet.

7. The system according to claim 1, wherein an eccentric distance of the other end of the eccentric shaft from the central position is ranged from 0.2 mm to 1 mm.

* * * * *